United States Patent [19]

Matsuoka et al.

[11] Patent Number: 4,918,045

[45] Date of Patent: Apr. 17, 1990

[54] RECORDING MATERIAL

[75] Inventors: Katsumi Matsuoka; Masanobu Takashima; Ken Iwakura; Keiso Saeki, all of Shizuoka, Japan

[73] Assignee: Fuji Photo Film Co., Ltd., Kanagawa, Japan

[21] Appl. No.: 219,407

[22] Filed: Jul. 15, 1988

[30] Foreign Application Priority Data

Jul. 15, 1987 [JP] Japan ..... 62-176627

[51] Int. Cl.[4] ..... B41M 5/16; B41M 5/22

[52] U.S. Cl. ..... 503/213; 427/151; 503/216; 503/220; 503/223

[58] Field of Search ..... 427/150–152; 428/913, 914; 503/213, 215, 220, 225, 223

[56] References Cited

FOREIGN PATENT DOCUMENTS 759800 6/1953 United Kingdom ..... 503/215

1292939 10/1972 United Kingdom ..... 503/213

1495126 12/1977 United Kingdom ..... 503/213

2040303 8/1980 United Kingdom ..... 503/220

2141729 1/1985 United Kingdom ..... 503/220

*Primary Examiner*—Bruce H. Hess

*Attorney, Agent, or Firm*—Sughrue, Mion, Zinn, Macpeak & Seas

[57] ABSTRACT

A recording material comprising a support, a microcapsule containing a substantially colorless electron-donating color former and a solvent, and an electron-accepting developer, wherein the color former is at least one selected from p-substituted aminophenylindolylphthalide derivatives, p-substituted aminophenylindolylazaphthalide derivatives and p-substituted aminophenylindolyldiazaphthalide derivatives, the solvent is a paraffin oil, and the amount of the solvent is at least 20% by weight based on the weight of the core substance.

13 Claims, No Drawings

RECORDING MATERIAL

FIELD OF THE INVENTION

The present invention relates to a recording material and more particularly to a recording material utilizing a color-forming reaction between a substantially colorless color former and an electron-accepting compound.

BACKGROUND OF THE INVENTION

A pressure-sensitive recording material may comprise a combination of an upper sheet and a lower sheet. The upper sheet may comprise a support having a microcapsule layer provided thereon, the microcapsule layer containing microcapsules which are prepared by dissolving a substantially colorless color former in a suitable hydrophobic solvent, dispersing in a hydrophilic liquid to form micro-droplets, and encapsulating the resulting oil droplets. The lower sheet may comprise a support having a developer layer provided thereon, the developer layer containing an electron-accepting compound (hereinafter referred to as a "developer"). Alternatively, the recording material may comprise a combination of an upper and a lower sheet and an intermediate sheet comprising a support and a microcapsule layer provided on one side of the support and a developer layer provided on the other side of the support, or a material containing the above-described capsules and developer in the same surface thereof, or a material which contains a first layer comprising one of the above capsules and developer, and on which a second layer comprising the other is coated.

These pressure-sensitive recording materials are described in, for example, U.S. Pat. Nos. 2,505,470, 2,505,489, 2,550,471, 2,730,457 and 3,418,250.

These pressure-sensitive recording sheets, however, have two disadvantages which are serious in practical use. First, the durability of the microcapsule layer containing the color former is not sufficiently high. Color-forming properties are reduced upon irradiation of the microcapsule layer with light. Second, the color-forming speed is slow, and the density just after printing is lower than that one day after printing.

SUMMARY OF THE INVENTION

An object of the present invention is to provide a recording material having a microcapsule layer which is improved in light resistance.

Another object of the present invention is to provide a recording material having a high color-forming speed.

Still another object of the present invention is to provide a recording material the thickness of which can be decreased by increasing the concentration of the color former.

The present invention relates to a recording material comprising a support, a microcapsule containing a substantially colorless electron-donating color former and a solvent, and an electron-accepting developer, wherein the color former is at least one selected from p-substituted aminophenylindolylphthalide derivatives, p-substituted aminophenylindolylazaphthalide derivatives and p-substituted aminophenylindolyldiazaphthalide derivatives, the solvent is a paraffin oil, and the amount of the solvent is at least 20% by weight based on the weight of the core substance (total contents of the substances contained in microcapsules).

DETAILED DESCRIPTION OF THE INVENTION

Preferred examples of p-substituted aminophenylindolylphthalide derivatives, p-substituted aminophenylindolylazaphthalide derivatives and p-substituted aminophenylindolyldiazaphthalide derivatives to be used in the present invention are represented by formula (I):

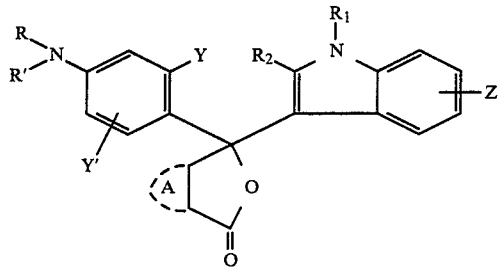

(I)

In formula (I), R and R' may be the same or different and are each an alkyl group, an aralkyl group, or an aryl group, $R_1$ and $R_2$ may be the same or different and are each a hydrogen atom, an alkyl group or an aryl group, and the ring A is a benzene ring, a pyridine ring or a pyrazine ring.

Y, Y' and Z are each a hydrogen atom, an alkyl group, a halogen atom, a substituted amino group or an alkoxy group.

The aryl group includes a phenyl group, a naphthyl group and a hetero aromatic ring group, each of which may be substituted by, for example, an alkyl group, an alkoxy group, an aryloxy group, a halogen atom, a nitro group, a cyano group, a substituted carbamoyl group, a substituted sulfamoyl group, a substituted amino group, a substituted oxycarbonyl group or a substituted oxysulfonyl group. The alkyl group includes a saturated or unsaturated alkyl group and a cycloalkyl group, which may be substituted by, for example, an aryl group, an alkoxy group, an aryloxy group, a halogen atom or a cyano group.

Of the substituents represented by R or R', an alkyl group having from 1 to 12 carbon atoms, an aralkyl group having from 7 to 12 carbon atoms, and an aryl group having from 6 to 12 carbon atoms are preferred, and they may be substituted by, for example, a halogen atom, an alkoxy group, an aryloxy group, an acryl group, a cyano group, a pyridyl group or a furfuryl group. R and R' may combine together to form a ring, preferably a 5- or 6-membered saturated hetero ring. Of the substituents represented by $R_1$, an alkyl group which may be substituted by an aryl group having from 1 to 18 carbon atoms, an alkoxy group, an aryloxy group or a halogen atom, and a phenyl group which may be substituted by an alkyl group having from 6 to 12 carbon atoms, an alkoxy group or a halogen atom are preferred. It is particularly preferred that the substituents represented by $R_1$ have 6 or more carbon atoms. Of the substituents represented by $R_2$, an alkyl group having from 1 to 8 carbon atoms, a phenyl group having from 6 to 10 carbon atoms and a hydrogen atom are preferred. Ring A is preferably a benzene ring, a pyridine ring containing nitrogen in the 4- or 7-position, or a pyrazine ring.

Ring A may be further substituted by a halogen atom, an alkyl group, an alkoxy group, an aryl group, an aryloxy group, a carbamoyl group, a substituted amino group, an acyl group, an alkanesulfo group, an alkoxycarbonyl group, a nitro group, a cyano group, or the like. Of the substituents represented by Y and Y', a hydrogen atom, an alkyl group having from 1 to 18 carbon atoms, an acyloxy group, a substituted amino group and an alkoxy group are preferred, and the alkoxy group having 6 or more carbon atoms is particularly preferred. Of the substituents represented by Z, a hydrogen atom, an alkyl group having from 1 to 12 carbon atoms and an alkoxy group are preferred. When $R_2$ is an alkyl group, it is preferred that the total number of carbon atoms of R, R', Y, $R_1$ and $R_2$ is 13 or more, and when $R_2$ is an aryl group, it is preferred that the total number of carbon atoms of R, R', Y, $R_1$ and $R_2$ is 18 or more, because the solubility of the color former in the organic solvent is increased. It is preferred that at least one of R, R', Y' and $R_1$ have 4 or more carbon atoms.

As the color former to be used in the present invention, those having a solubility at 20° C. of at least 5 g in 100 g of diisopropylnaphthalene (trade name, KMC113 produced by Kureha Kagaku Co., Ltd.) are preferred and those having a solubility at 20° C. of 10 g or more in 100 g of diisopropylnaphthalene are particularly preferred.

Representative examples are shown below.

3-(4-Diethylamino-2-ethoxyphenyl)-3-(1-n-hexyl -2-methylindole-3-yl)phthalide, 3-(4-diethylamino-2-ethoxyphenyl)-3-(1-n-octyl-2-methylindole-3-yl)phthalide, 3-(4-diethylamino-2-ethoxyphenyl)-3-(1-n-dodecyl-2-methylindole-3-yl)phthalide, 3-(4-diethylamino-2-ethoxyphenyl)-3-(1-n-octyldecyl-2-methylindole-3-yl)phthalide, 3-(4-di-n-butylamino-2-ethoxyphenyl)-3-(1-n-butyl-2-methylindole-3-yl)phthalide, 3-(4-di-n-butylamino-2-butoxyphenyl)-3-(1-ethyl-2-methylindole-3-yl)phthalide, 3-(4-N-benzyl-N-ethylamino-2-ethoxyphenyl)-3-(1-n-hexyl -2-methylindole-3-yl)phthalide, 3-(4-N-ethyl-N-isoamyl -amino-2-isoamyloxyphenyl)-3-(1-ethyl-2-methylindole-3yl)-phthalide, 3-(4-diethylamino-2-n-octadecyloxyphenyl) -3-(1-ethyl-2-methylindole-3-yl)phthalide, 3-[4-N-benzyl -N-ethylamino-2-(2-ethylhexyloxy)phenyl]-3-(1-ethyl-2-methylindole-3-yl)phthalide, 3-(4-N-butyl-N-ethylamino-2-methylphenyl)-3-[1-(2-ethylhexyl)-2-methylindole-3-yl]-phthalide, 3-(4-diethylamino-2-ethoxyphenyl)-3-(1-benzyl -2-methylindole-3-yl)phthalide, 3-(4-diethylamino-2-butoxyphenyl)-3-(1-benzyl-2-methylindole-3-yl)phthalide, 3-(4-diethylamino-2-ethoxyphenyl)-3-(1-n-octyl-2 -methylindole-3-yl)-4- or 7-azaphthalide, 3-(4-diethyl -amino-2-ethoxyphenyl)-3-(1-n-octyl-2-methylindole-3-yl) -4,7-diazaphthalide, 3-(4-diethylamino-2-ethoxyphenyl)-3-(1-n-dodecyl-2-methylindole-3-yl)-4- or 7-azaphthalide, -(4-diethylamino-2-ethoxyphenyl)-3-(1-n-octadecyl-2-methylindole-3-yl)-4,7-diazaphthalide, 3-(2,4-diethyl -amino-2-ethoxyphenyl)-3-(1-n-octadecyl-2-methylindole-3-yl)-4- or 7-azaphthalide, etc.

From the viewpoint of color hue of the p-substituted aminophenylindolylphthalide derivatives, 4-substituted amino-2-alkoxyphenylindolylphthalide is preferred, p-substituted aminophenylindolylazaphthalide derivatives, 4-substituted amino-2-alkoxyphenylindolyl-4- or 7-azaphthalide is preferred, and p-substituted aminophenylindolyldiazaphthalide derivatives, 4-substituted amino-2-alkoxyphenylindolyl-1,4-diazaphthalide is preferred.

In the recording material of the present invention, p-substituted aminophenylindolylphthalide derivatives and/or p-substituted aminophenylindolylazaphthalide derivatives and/or p-substituted aminophenylindolyldiazaphthalide derivatives may be used in combination with various known color-forming compounds such as triphenylmethane phthalide-based compounds, fluoran-based compounds, phenothiazine-based compounds, indolylazaphthalide-based compounds, leuco auramine-based compounds, rhodamine lactam-based compounds, triphenylmethane-based compounds, triazene-based compounds, spiropyran-based compounds, and the like, as described, for example, in U.S. Pat. Nos. 3,491,111, 3,491,112, 3,491,116, 3,509,174, 3,624,107, 3,627,787, 3,641,011, 3,462,828, 3,681,390, 3,920,510, 3,959,571, 3,971,808, 3,775,424, 3,853,869, 4,246,318, etc.

In this case, from the viewpoint of improving characteristics, it is preferred that they be used in such an amount that the concentration of the colorless dye of the present invention is at least 60%.

As the paraffin oil to be used in the present invention, those having from 6 to 20 carbon atoms are preferred, those having from 10 to 18 carbon atoms are more preferred, and those having a branch chain are particularly preferred. A fraction having a specific gravity at 4° C. of from 0.73 to 0.82 is preferred, and a fraction having a viscosity at 37.8° C. of from 1.0 to 10.0 centistokes and a boiling point range of 150° C. or more is preferred, with a fraction having a boiling point range of from 150° to 270° C. being particularly preferred.

Specific examples include IP Solvent 1620 (specific gravity: 0.762; viscosity: 1.3 centistokes; boiling point range: 166° to 205° C.), and IP Solvent 2028 (specific gravity: 0.790; viscosity: 2.6 centistokes; boiling point range: 210° to 265° C., produced by Idemitsu Sekiyu Kagaku Co., Ltd.).

The paraffin oil may be used in admixture with aromatic hydrocarbons, chlorinated paraffins, aromatic esters, aromatic diethers and the like. Examples of aromatic hydrocarbons are diarylalkane, alkylated naphthalene, alkylated biphenyl and the like. As the diarylalkane, alkylated diphenylmethane, alkylated diphenylethane, alkylated diphenylpropane and the like are preferred. Specific examples are dixylylmethane, 1-phenyl-1-xylylethane, 1-phenyl-2-(trimethylphenyl)-ethane, -1-phenyl-1-xylylpropane, 1-isopropylphenyl-2-phenylethane and the like. Specific examples of the alkylated naphthalene are isopropylnaphthalene, methylpropylnaphthalene, diethylnaphthalene, diisopropylnaphthalene, ethylisopropylnaphthalene, methylbutylnaphthalene and the like. Specific examples of the alkylated biphenyl are diethylbiphenyl, isopropylbiphenyl, methylpropylbiphenyl and the like. Specific examples of the chlorinated paraffin are chlorinated paraffins having 6 to 18 carbon atoms as described in British Patent No. 1,296,447. Of these solvents, 1-isopropylphenyl-2-phenylethane, 1-phenyl-1-(dimethylphenyl)ethane and diisopropylnaphthalene are preferred.

Regarding the composition of the color former and the solvent in the present invention, the proportion of the color former is preferably from 4 to 25% by weight based on the weight of the core substance and particularly preferably from 6 to 20% by weight. The proportion of the paraffin oil is preferably from 20 to 96% by weight based on the weight of the core substance and particularly preferably from 30 to 84% by weight. When they are used in combination with aromatic hydrocarbons, the proportion of the aromatic hydrocarbon is preferably from 5 to 76% by weight based on the weight of the core substance and particularly preferably from 10 to 45% by weight.

In the microcapsule of the present invention, as additives, an ultraviolet absorbing agent, a hindered phenol derivative, a hindered amine derivative, and a nickel compound may be incorporated. They may be dissolved along with a color former or they may be dissolved independently. Of these additives, an ultraviolet absorbing agent is particularly preferred. Incorporation of an ultraviolet absorbing agent in the core substance provides better results in the light resistance of microcapsule layer.

Representative examples of these additives are disclosed, for example, in Japanese Patent Application No. 62-58514 filed on Mar. 13, 1987, and U.S. patent application Ser. No. 158,468 filed on Feb. 22, 5, 1988 Specific examples of these additives are as follows.

As the hindered phenol, phenol derivatives substituted by a branched alkyl group in at least one of the 2- and 6-positions are preferred. Examples of such hindered phenol derivatives are 1,1-bis(2-methyl-4-hydroxy-5-t-butylphenyl)butane, 1,1,3-tris(3-methyl-4-hydroxy-5-t-butylphenyl)butane, bis(2-hydroxy-3-t-butyl -5-methylphenyl)methane, bis(2-methyl-4-hydroxy-5-t -butylphenyl)sulfide, etc.

The hindered amines to be added include the following compounds.

(i)

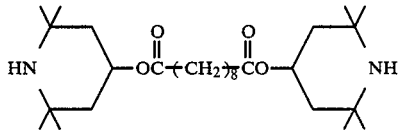

(ii)

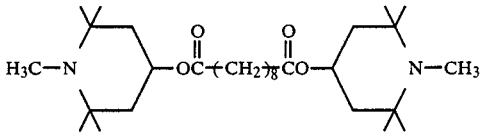

(iii)

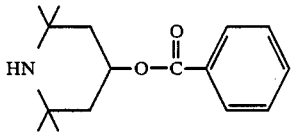

(iv)

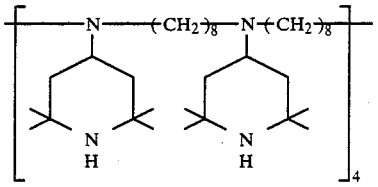

(v)

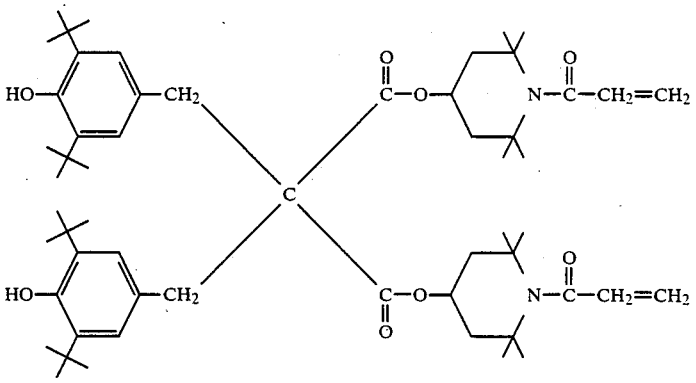

-continued
(vi)
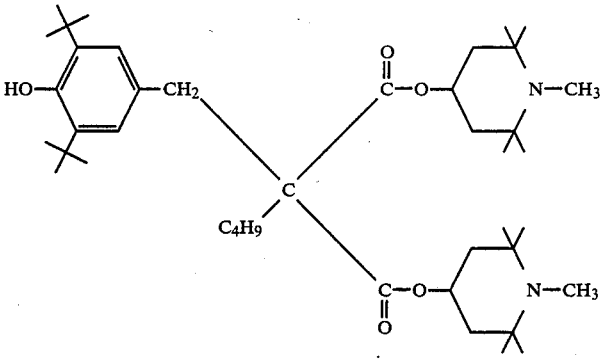
(vii)
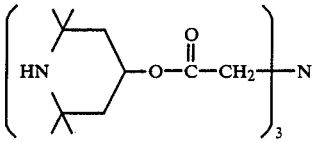
(viii)
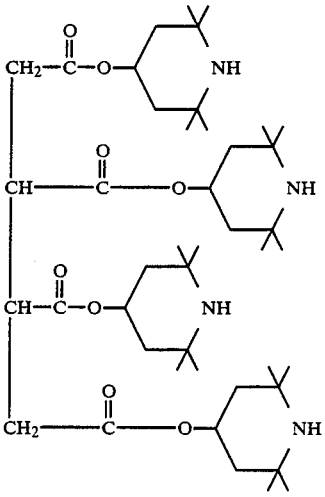
(ix)
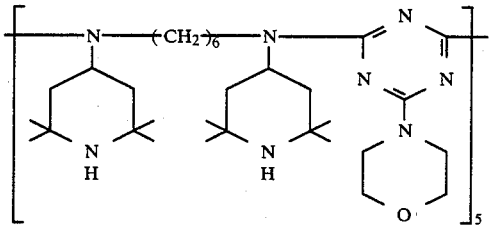
(x)
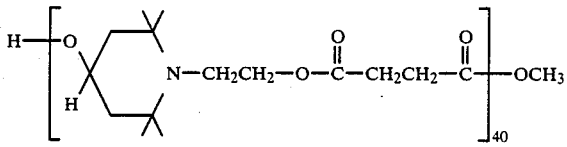

-continued (xi)

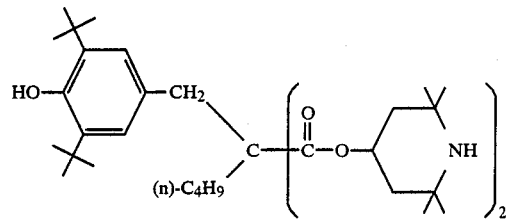

(xii)

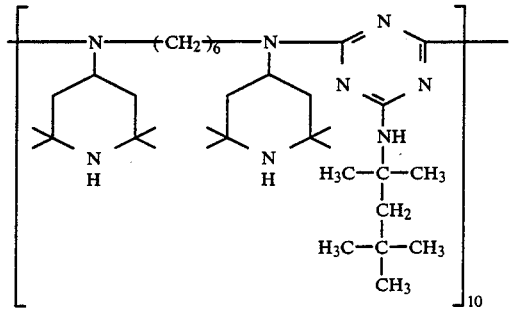

The nickel compounds to be added include nickel compounds represented by formula (II):

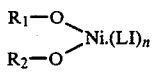

(II)

wherein $R_1$ and $R_2$, which combine with each other to form a hetero ring or hetero ring system, each represents an aryl group; LI represents an organic ligand which is bonded to the nickel ion via a hetero atom to form a complex; and n represents 0, 1 or 2;

and nickel compounds-represented by formula (III)

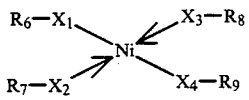

(III)

wherein $R_6$, $R_7$, $R_8$ and $R_9$ each represents an aryl group, and the pair $R_6$ and $R_7$, and the pair $R_8$ and $R_9$ may each combine with each other to form a hetero ring or hetero ring system, respectively; $X_1$ and $X_4$ each represents an oxygen atom or a sulfur atom; and $X_2$ and $X_3$ each represents a hydroxyl group or a mercapto group. It is particularly preferred that the nickel compounds have a solubility in toluene of 1 or more.

Further, chelates of nickel with bisdithio-α-diketone, acetylacetone, salicylaldehydroxime, thiobisphenol, aliphatic carboxylic acids, aliphatic sulfonic acids, aromatic carboxylic acids, and the like can be also used as the nickel compounds. Specific examples of these nickel chelates are Ni (II) dithiobenzyl, Ni (II) dithiobiacetyl, Ni (II) acetylacetonate, Ni (II) o-(N-isopropylformamidoyl)phenol, Ni (II) o-(N-dodecylformimidoyl)-phenol, Ni (II) 2,2'-[ethylenebis(nitrilomethylidyne)]diphenol, Ni (II) salicylaldehyde phenylhydrazone, Ni (II) bis[2,2'-thiobis(4-t-octyl) -phenolate], Ni (II) n-butylamino[2,2'-thiobis(4-t-octyl) -phenolate], Ni (II) anilino[2,2'-thiobis(4-t-octyl) -phenolate], Ni (II) 2-ethylhexylcarboxylate, etc.

Preferred of the ultraviolet absorbing agents are those having a spectral absorption at 270 to 380 nm. Examples include salicylic acid-based ultraviolet absorbing agents, e.g., phenyl salicylate, p-tert-butylphenyl salicylate, p-octylphenyl salicylate and the like, benzophenone-based ultraviolet absorbing agents, e.g., 2,4-dihydroxybenzophenone, 2-hydroxy-4-methoxybenzophenone, 2-hydroxy-4-octoxybenzophenone, 2-hydroxy -4-dodecyloxybenzophenone, 2,2'-dihydroxy-4-methoxybenzophenone, 2,2'-dihydroxy-4,4'-dimethoxybenzophenone, 2-hydroxy-4-methoxy-5-sulfobenzophenone and the like, benzotriazole-based ultraviolet absorbing agents, e.g., 2-(2'-hydroxy-5'-methylphenyl)benzotriazole, 2-(2'-hydroxy-5'-tert-butylphenyl)benzotriazole, 2-(2'-hydroxy -3',5'-di-tert-butylphenyl)benzotriazole, 2-(2'-hydroxy -3'-tert-butyl-5'-methylphenyl)-5-chlorobenzotriazole, 2-(2'-hydroxy-3',5'-di-tert-butylphenyl)-5-chlorobenzotriazole, 2-(2'-hydroxy-3',5'-di-tert-amylphenyl) -benzotriazole, 2-(2'-hydroxy-4'-octoxyphenyl)benzotriazole and the like, and cyanoacrylate-based ultraviolet absorbing agents, e.g., 2-ethylhexyl-2-cyano -3,3'-diphenyl acrylate, ethyl-2-cyano-3,3'-diphenyl acrylate and the like. Of these, benzotriazole-based ultraviolet absorbing agents are preferred.

The amount of the above additives used is preferably from 5 to 200% by weight, more preferably from 10 to 100% by weight, based on the weight of the color former.

Further, the core substance in the microcapsules has preferably a viscosity of 100 cps or less, measured by a Brookfield viscometer at 20° C., and particularly preferably 50 cps or less.

Examples of the recording material containing the microcapsule of the present invention include a pressure-sensitive recording material, a heat-sensitive recording material, and the like.

The pressure-sensitive recording material can take forms as described, for example, in U.S. Pat. Nos. 2,505,470, 2,505,471, 2,505,489, 2,548,366, 2,712,507, 2,730,456, 2,730,457, 3,103,404, 3,418,250 and 4,010,038. The most typical pressure-sensitive recording material comprises at least one pair of sheets independently containing microcapsules containing an electron-donating colorless dye and an electron-accepting compounds.

The heat-sensitive recording material can take forms as described, for example, in U.S. Pat. No. 4,682,194 and JP-A-60-244594 (the term "JP-A" as used herein means an "unexamined published Japanese patent application"). The most typical is such that microcapsules containing a color former and a developer are coated on the same sheet.

Capsules are produced, for example, by a method utilizing coacervation of hydrophilic colloid sol as described in U.S. Pat. Nos. 2,800,457 and 2,800,458, an interfacial polymerization method as described in British Pat. Nos. 867,797, 950,443, 989,264 and 1,091,076, and a method as described in U.S. Pat. No. 3,103,404.

Representative examples of the electron accepting developer which reacts with the color former to be used in the recording sheet of the present invention are disclosed, for example, in Japanese Patent Application No. 62-58514 filed on Mar. 13, 1987 and U.S. patent application Ser. No. 158,418 filed on Feb. 22, 1988. Preferred examples of these developers are compounds represented by formulae (IV) to (VII) shown below:

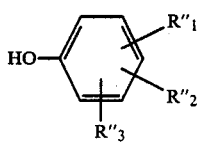

(IV)

wherein $R''_1$ and $R''_2$, which may be the same or different, each represents a hydrogen atom, an alkyl group, an alkenyl group, an alkynyl group, an alkoxy group, an aryl group, an arylsulfonyl group, an alkoxycarbonyl group or a halogen atom; and $R''_3$ represents a hydrogen atom or a group represented by formula (a):

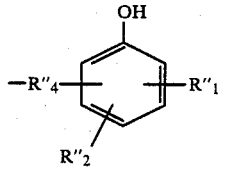

(a)

wherein $R''_1$ and $R''_2$ are as defined above; and $R''_4$ represents a divalent group having from 1 to 12 carbon atoms or $SO_2$.

Among the compounds of formula (IV), preferred are those wherein $R''_3$ is a hydrogen atom, and $R''_1$ and $R''_2$ each is a hydrogen atom or an alkoxycarbonyl group and those wherein $R''_3$ is a group of formula (a); and $R''_4$ is an alkylene group having from 3 to 12 carbon atoms, a cycloalkylene group having from 5 to 7 carbon atoms, an aralkylene group having from 8 to 12 carbon atoms or $SO_2$ In formulae (IV) and (a), the terms "alkyl group", "alkenyl group" and "alkynyl group" mean an acyclic or cyclic alkyl, alkenyl and alkynyl group, respectively, which may be unsubstituted or substituted with an aryl group, an alkoxy group, an aryloxy group, a halogen atom, a cyano group, etc.

Illustrative examples of the developers represented by formula (IV) are 4-phenylphenol, bisphenolsulfone, p-phenylsulfonylphenol, p-tolylsulfonylphenol, bis(3-vinyl-4-hydroxyphenyl)sulfone, 2,2-bis(3-vinyl-4-hydroxyphenyl)propane, bis-3-allyl-4-hydroxyphenylsulfone, hexyl 4-hydroxybenzoate, 2,2'-dihydroxybiphenyl, 4-t-butylphenol, 4-t-octylphenol, 4-chlorophenylphenol, 2,2-bis(4-hydroxyphenyl)propane, 4,4'-isopyridenebis(2-methylphenol), 1,1-bis(3-chloro-4 -hydroxyphenyl)cyclohexane, 1,1-bis(3-chloro-4-hydroxyphenyl)-2-ethylbutane, 4,4'-sec-isooctylidenediphenol, 4,4'-sec-butylidenediphenol, 4-p-methylphenylphenol, 4,4'-isopentylidenediphenol, 4,4'-methylcyclohexylidenediphenol, 4,4'-dihydroxydiphenyl sulfide, 1,4-bis(4'hydroxycumyl)benzene, 1,3-bis(4'-hydroxycumyl)benzene, 4,4'-thiobis(6-t-butyl-3-methylphenol), 4,4'-dihydroxydiphenylsulfone, hydroquinone monobenzyl ether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenethyl 4-hydroxybenzoate, 4-hydroxy-2',4'-dimethyldiphenylsulfone, β-phenethyl orsellinate, cinnamyl orsellinate, o-chlorophenoxyethyl orsellinate, o-ethylphenoxyethyl orsellinate, m-phenylphenoxyethyl orsellinate, β-3'-t -butyl-4'-hydroxyphenoxyethyl 2,4-dihydroxybenzoate, 1-t -butyl-4-p-hydroxyphenylsulfonyloxybenzene, 4-N-benzyl sulfamoylphenol, p-methylbenzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, β-phenoxybutyl p-hydroxybenzoate, δ-phenoxybutyl p-hydroxybenzoate, β-p-methoxyphenoxyethyl, 2,4,6-trihydroxybenzoate, β-p-butoxyphenoxyisopropyl p-hydroxybenzoate, β-p-methoxyphenoxyethoxyethyl 2,4-dihydroxybenzoate, phenoxybutyl orsellinate, p-methoxyphenoxyethyl β-resorcylate, β-p-methoxyphenoxyethoxyethyl orsellinate, β-o-methoxyphenoxyethyl orsellinate, tolyloxyethyl orsellinate, β-p-methoxyphenoxypropyl orsellinate, phenoxyethyl β-resorcylate, δ-p-methoxyphenoxybutyl β-resorcylate, etc.

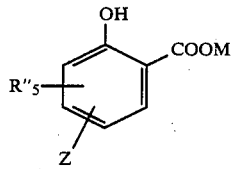

(V)

wherein $R''_5$ represents a hydrogen atom, an aryl group, a heterocyclic aromatic group, a substituted amino group, an alkoxy group, an alkyl group, an alkenyl group, or an alkynyl group; Z represents an alkyl group, an alkenyl group, an alkynyl group, an alkoxy group or a halogen atom; and M represents a hydrogen atom or $M'^{1/l}$, wherein M' represents an l-valent metal atom and l represents an integer of from 1 to 3.

In formula (V), the terms "alkyl group", "alkenyl group" and "alkynyl group" mean acyclic or cyclic alkyl, alkenyl and alkynyl groups, respectively, which may be substituted with an aryl group, an alkoxy group, an aryloxy group, a halogen atom, an acylamino group, an aminocarbonyl group, a cyano group, etc. The term "aryl group" may mean a phenyl group or a naphthyl group, and the aryl group and heterocyclic aromatic group may be unsubstituted or substituted with an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

$R''_5$ preferably represents a hydrogen atom, a phenyl group or an alkyl, alkenyl or alkynyl group having from 1 to 22 carbon atoms. Z preferably represents an alkyl, alkenyl or alkynyl group having from 1 to 22 carbon atoms, an alkoxy group having from 1 to 20 carbon atoms, a chlorine atom or a fluorine atom. M' preferably represents a zinc, aluminum, magnesium or calcium atom.

The substituents for the alkyl, alkenyl, alkynyl, or alkoxy group represented by Z preferably includes an aryl group having from 6 to 12 carbon atoms, an aryloxy group having from 6 to 16 carbon atoms, an alkoxy group having from 1 to 12 carbon atoms, a halogen atom, and an alkoxycarbonyl group. $R_5$ and Z may combine to form a naphthalene ring.

The salicylic acid derivatives represented by formula (V) preferably contain at least 14, and more preferably at least 16, carbon atoms in total in view of nonaqueous solubility. These salicylic acid derivatives may be used either in the form of a free acid or a metal salt and may be dispersed in a dispersion medium in the presence of, for example, zinc oxide to form a salt in situ or to cause adsorption or double decomposition.

Specific examples of the compounds of formula (V) are 4-pentadecylsalicylic acid, 3-phenylsalicylic acid, 3-cyclohexylsalicylic acid, 3,5,5-di-t-butylsalicylic acid, 3,5-didodecylsalicylic acid, 3-methyl-5-benzylsalicylic acid, 3-phenyl-5-(α,α-dimethylbenzyl)salicylic acid, 3,5-di(α-methylbenzyl)salicylic acid, 3,5-di-t -octylsalicylic acid, 5-tetradecylsalicylic acid, 5-hexadecylsalicylic acid, 5-octadecylsalicylic acid, 5-α-(p-α-methylbenzylphenyl)ethylsalicylic acid, 4-dodecyloxysalicylic acid, 4-tetradecyloxysalicylic acid, 4-hexadecyloxysalicylic acid, 4-β-phenoxyethoxysalicylic acid, 4-β-p-tolyloxyethoxysalicylic acid, 4-β-p-ethylphenoxyethoxysalicylic acid, 4-β-p-methoxyphenoxyethoxysalicylic acid, 4-β-p-ethoxyphenoxyethoxysalicylic acid, 4-β-m-tolyloxyethoxysalicylic acid, 4-β-o-tolyloxyethoxysalicylic.acid, 4-(β-phenoxyoctyloxy)salicylic acid, 3-xylyl-5-(α,α-dimethylbenzyl)salicylic acid, 2-hydroxy-1-α-ethylbenzyl-3-naphthoic acid, 3,5-dicyclopentadienylsalicylic acid, a carboxyl-modified terpenephenol resin, etc.

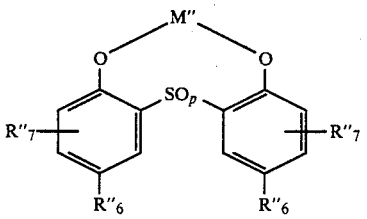

(VI)

wherein $R''_6$ represents a hydrogen atom, an aryl group, an alkyl group or a halogen atom; $R''_7$ represents a hydrogen atom, an alkyl group, an alkoxy group or a halogen atom; M'' represents a divalent metal atom; and p represents 0, 1 or 2.

Specific examples of the compounds of formula (VI) are zinc, nickel or magnesium salts of bis(2-hydroxy-5-butylphenyl)sulfone, bis(2-hydroxy-5-phenylphenyl)-sulfone, bis(2-hydroxy-5-octylphenyl)sulfone, bis(2-hydroxy-5-chlorophenyl)sulfone, bis(2-hydroxy-3-chloro-5-butylphenyl)sulfone, etc.

$$(R)_2Zn(A)_2 \qquad \text{(VII)}$$

wherein R represents a monodentate or polydentate colorless organic ligand connected to the Zn ion via a hetero atom to form a complex; and A represents SCN, a chlorine atom or a benzoate anion having a nucleophilic group.

The colorless organic ligand represented by R preferably includes pyridine, imidazole, quinoline, benzothiazole, benzimidazole and antipyrine ligands, each of which may be substituted with an alkyl group, a cyano group, an alkoxy group, a phenyl group, an amino group, a formyl group, a vinyl group, etc.

Specific examples of the compounds of formula (VII) are complexes of zinc rhodanide with imidazole, 2-phenylimidazole, picoline, pyridine, 2-benzylimidazole, benzimidazole, 2,3-dimethyl-1-phenyl-3-pyrazolin-5-one, 1-phenyl-2-methyl-3-benzyl-3-pyrazolin-5-one, 1-phenyl-2 -methyl-3-(2-ethylhexyl)-3-pyrazolin-5-one, 1-phenyl-2-methyl-3-isopropyl-3-pyrazolin-5-one, 1-phenyl-2,3-dibenzylpyrazolin-5-one, 1-phenyl-2-benzyl-3-methylpyrazolin-5-one, etc.

In addition to the compounds represented by formulae-(IV) to (VII), color developers which can be used in the present invention further include acetylacetone complexes of molybdic acid, ditolylthiourea, 4,4'-diacetyldiphenylthiourea, novolak resins, metal-treated novolak resins (e.g., novolak resins as described in German Patent Application (OLS) No. 2,235,491), p-phenylphenol-formalin resins, p-butylphenol-acetylene resins, inorganic acids, terra abla, active clay, attapulgite, colloidal silica, aluminum silicate, magnesium silicate, zinc silicate, tin silicate, zinc rhodanide, zinc chloride, iron stearate, cobalt naphthenate, nickel peroxide, ammonium nitrate, bentonite, oxalic acid, malic acid, tartaric acid, citric acid, succinic acid, stearic acid, and the like. The above-described color developers may be used either individually or in combinations thereof.

The developer is coated on a support such as paper, synthetic paper, plastic sheet, etc., along with a binder such as a styrene-butadiene latex.

The pressure-sensitive recording microcapsule sheet of the present invention is tested for its performance using the following developer sheet.

Preparation of Developer Sheet

2 Parts of zinc oxide, 18 parts of calcium carbonate and 4 parts of zinc 3,5-di-α-methylbenzyl disalicylate were mixed into 70 parts of water and dispersed for 30 minutes by the use of an attritor. To the solution thus-obtained, 2.5 parts as solids of a carboxy-modified SBR latex and 12 parts of a 10 wt% aqueous PVA (degree of saponification: 99%; degree of polymerization: 1,000) were added, and the resulting mixture was uniformly stirred to obtain a coating solution This coating solution was coated on a paper (50 g/m$^2$) in such a manner that 4 g/m$^2$ of solids was coated by the use of an air knife coater, and then dried to prepare a developer sheet.

The present invention is described in greater detail with reference to the following examples, although it is not limited thereto. Unless otherwise specified, all parts are by weight.

EXAMPLES 1 TO 6 AND COMPARATIVE EXAMPLES 1 AND 2

In 120 parts of a 4.5% aqueous solution of partial sodium salt of polyvinylbenzene sulfonic acid (average molecular weight: 500,000) adjusted to pH 6.0 were dispersed 2 parts of 2-(2'-hydroxy-3',5'-di-tertbutylphenyl)-5-chlorobenzotriazole as an ultraviolet absorber and 100 parts of a color former oil prepared by dissolving a color former shown in Table 1 in a solvent shown in Table 1 to thereby obtain an emulsion having such a particle size that the average particle diameter was 5.5 μm. Independently, 6 parts of melamine, 11 parts of a 37% by weight aqueous formaldehyde solution and 30 parts of water were heated at 60° C. and stirred, and in 30 minutes a transparent aqueous solution of a mixture of melamine, formaldehyde and a melamine-formaldehyde initial condensate was obtained. The pH of the aqueous solution of the mixture was 6.0 to 8.0. This aqueous solution of the mixture of melamine, formaldehyde and the melamine-formaldehyde initial condensate is hereinafter referred to as an "initial condensate solution". The initial condensate solution obtained by the above method was added to the above dispersion and mixed. The pH of the mixture was adjusted to 6.0 by adding a 3.6% by weight hydrochloric acid solution while stirring, the temperature was raised to 65° C., and the mixture was stirred for 360 minutes.

The capsule solution was cooled to room temperature and adjusted to pH 9.0 with 20% by weight sodium hydroxide.

To the capsule solution were added 100 parts of a 10% by weight aqueous solution of polyvinyl alcohol, 10 parts as solids of a carboxy modified SBR (styrene butadiene rubber) latex, 50 parts of starch particles, and 10 parts of calcium carbonate, and water was added thereto to adjust the solids concentration to 20%, thereby preparing a color former-containing microcapsule coating solution.

This coating solution was coated on a paper (50 g/m$^2$) in an amount of 4 g/m$^2$ The results are shown in Table 1.

$$\text{Light Resistance} = \frac{\text{Density at Maximum Absorption after Irradiation with Fluorescent Lamp } (D)}{\text{Fresh Density at Maximum Absorption } (D_0)}$$

As the value of light resistance is higher, the light resistance of the microcapsule layer is higher.

$$\text{Color Formation Speed} = \frac{\text{Density at Maximum Absorption after 15 Seconds from Start of Color Formation}}{\text{Density at Maximum Absorption after 5 Minutes from Start of Color Formation}}$$

The color density is a value measured by the use of Hitachi Color Analyzer Model 307, at a maximum absorption in a spectral absorption curve of a colored substance in the wavelength range of 380 to 780 nm.

It can be seen from Table 1 that when paraffin oil is used in the core in an amount of at least 20% by weight, the color formation speed is increased and the light resistance of the microcapsule layer is increased.

TABLE 1

| Example No. | Color Former | Solvent | Color Formation Speed | Light Resistance of Microcapsule Layer |
|---|---|---|---|---|
| Example 1 | 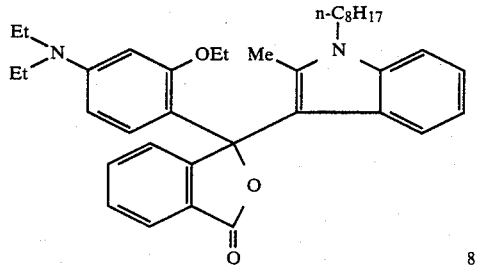 8 parts | Diisopropylnaphthalene/IP Solvent 1620 20 parts/70 parts | 0.95 | 0.96 |
| Example 2 | 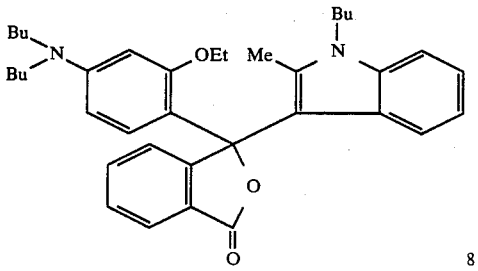 8 parts | Diisopropylnaphthalene/IP Solvent 1620 45 parts/45 parts | 0.95 | 0.96 |

TABLE 1-continued

| Example No. | Color Former | Solvent | Color Formation Speed | Light Resistance of Microcapsule Layer |
|---|---|---|---|---|
| Example 3 | 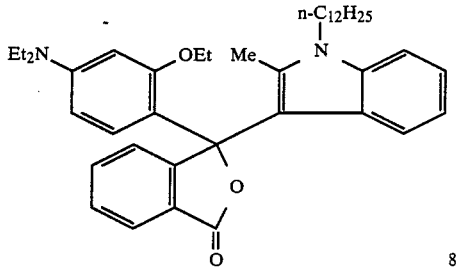 8 parts | Diisopropyl-naphthalene/IP Solvent 1620 70 parts/20 parts | 0.90 | 0.91 |
| Comparative Example 1 | 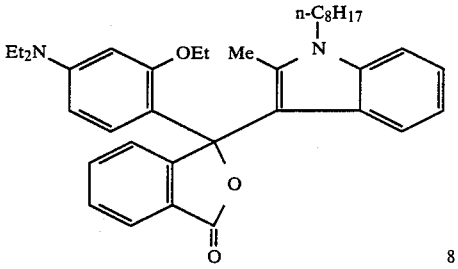 8 parts | Diisopropyl-naphthalene/IP Solvent 1620 80 parts/10 parts | 0.80 | 0.80 |
| Example 4 | 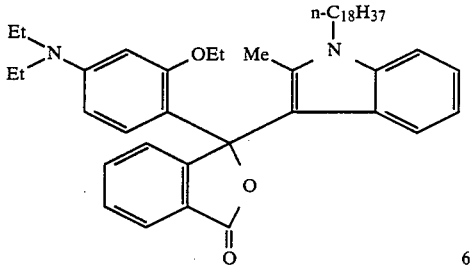 6 parts + 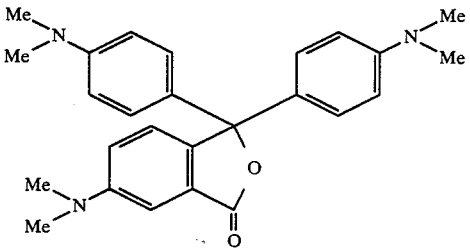 2 parts | Diisopropyl-naphthalene/IP Solvent 1620 20 parts/70 parts | 0.92 | 0.85 |
| Example 5 | 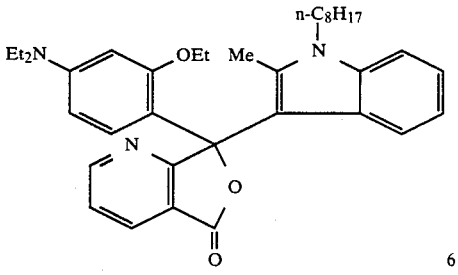 6 parts + | Diisopropyl-naphthalene/IP Solvent 1620 45 parts/45 parts | 0.90 | 0.85 |

TABLE 1-continued

| Example No. | Color Former | Solvent | Color Formation Speed | Light Resistance of Microcapsule Layer |
|---|---|---|---|---|
| | 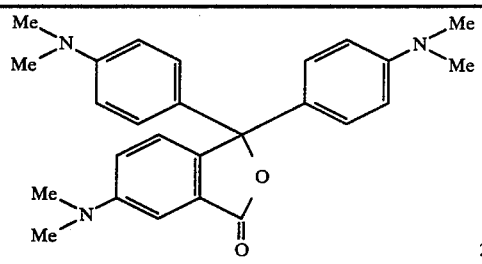 2 parts | | | |
| Example 6 | 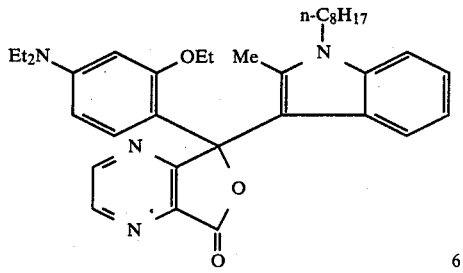 6 parts + 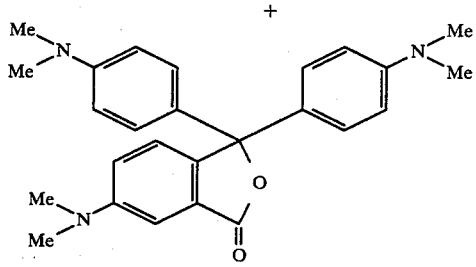 2 parts | Diisopropyl-naphthalene/IP Solvent 1620 70 parts/20 parts | 0.87 | 0.83 |
| Comparative Example 2 | 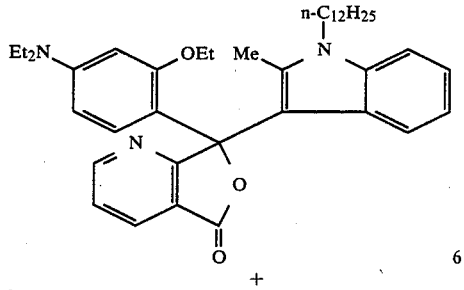 6 parts + 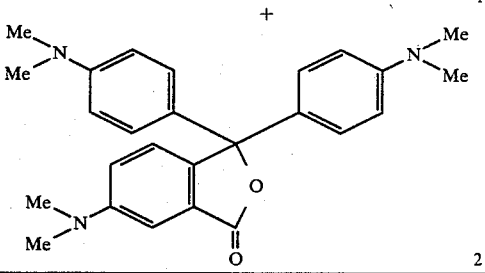 2 parts | Diisopropyl-naphthalene/IP Solvent 1620 80 parts/10 parts | 0.75 | 0.68 |

EXAMPLE 7 AND COMPARATIVE EXAMPLE 3

A mixture of 8 parts of 3-(4-diethylamino-2-ethoxy)-3-(η-n-'octyl-2-methylindole-3-yl)-4-azaphthalide as a color former and 2 parts of 2-(2'-hydroxy-3',5'-ditert-butylphenyl)-5-chlorobenzotriazole as an ultraviolet absorber-were dissolved in a mixed solvent of 30 parts of IS solvent, 60 parts of diisopropylnaphthalene and 15 parts of methylene chloride to prepare a solution forming a core substance. Then, 15 parts of a xylene diisocyanate/trimethylolpropane (3/1 mol ratio) adduct was added to and dissolved in the above solution. The resulting solution was mixed with a solution of 45 parts of polyvinyl alcohol in 60 parts of water and dispersed therein at 20° C. to prepare an emulsion having an average particle diameter of 2 μm. Then, 100 parts of water was added to the emulsion, and the resulting mixture was heated to 60° C. while stirring. After 1.5 hours, a capsule solution containing the color former in the core substance was obtained.

20 parts of isphenol A was added to 100 parts of a 5% aqueous solution of polyvinyl alcohol and dispersed therein for about 24 hours by a sand mill to thereby prepare a dispersion of bisphenol A having an average particle size of 2 μm.

To 5 parts of the capsule solution was added 3 parts of the bisphenol A dispersion to prepare a coating solution. The coating solution thus prepared was coated on a high quality paper (50 g/m²) having a smooth surface in such an amount that the dry weight was 5 g/m², and then dried at 40° C. for 2 minutes to prepare a heat-sensitive recording material.

For comparison, a heat-sensitive recording material was prepared in the same manner as in the above Example 7 except that 1-isopropylphenyl-2-phenylethane was used in place of IP solvent (Comparative Example 3).

In the obtained heat-sensitive recording materials, the color formation speed was evaluated using a heat-stamp at 110° C. for 1 second and the light resistance before the image recording was evaluated in the same manner as in Examples 1 to 6 under the same conditions as the color formation speed test.

The results are shown in Table 2.

TABLE 2

| Example No. | Color Formation Speed | Light Resistance of Microcapsule Layer |
|---|---|---|
| Example 7 | 0.95 | 0.95 |
| Comparative Example 3 | 0.92 | 0.85 |

While the invention has been described in detail and with reference to specific embodiments thereof, it will be apparent to one skilled in the art that various changes and modifications can be made therein without departing from the spirit and scope thereof.

We claim:

1. A recording material comprising:

a support;

a microcapsule containing a substantially colorless electron-donating color former and a solvent; and an electron accepting developer, wherein said color former is at least one selected from p-substituted aminophenylindolylphthalide derivatives, p-substituted aminophenylindolylazaphthalide derivatives and p-substituted aminophenylindoyldiazaphthalide derivatives, represented by

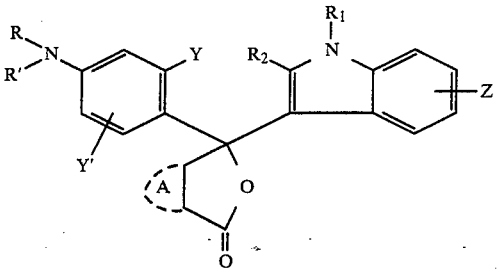

(I)

wherein

R and R' may be the same or different and are each an alkyl group, an aralkyl group, or an aryl group, $R_1$ and $R_2$ may be the same or different and are each a hydrogen atom, an alkyl group or an aryl group, ring A is a benzene ring, a pyridine ring, or a pyrazine ring, and, Y, Y', and Z are each a hydrogen atom, an alkyl group, a halogen atom, a substituted amino group, or an alkoxy group, and said solvent is paraffin oil, and the amount of said solvent is at least 20% by weight based on the weight of the total contents of substances contained in said microcapsules.

2. A recording material as in claim 1, wherein the p-substituted aminophenylindolylphthalide derivatives, p-substituted aminophenylindolylazaphthalide derivatives and p-substituted aminophenylindolyldiazaphthalide derivatives have a solubility at 20° C. of at least 5 g in 100 g of diisopropylnaphthalene.

3. A recording material as in claim 1, wherein said paraffin oil is a paraffin oil having from 6 to 20 carbon atoms.

4. A recording material as in claim 1, wherein said paraffin oil is a paraffin oil having from 10 to 18 carbon atoms.

5. A recording material as in claim 1, wherein said paraffin oil is a paraffin oil having a branch chain.

6. A recording material as in claim 1, wherein said paraffin oil is a paraffin oil having a specific gravity at 4° C. of from 0.73 to 0.82.

7. A recording material as in claim 1, wherein said paraffin oil is a paraffin oil having a viscosity at 37.8° C. of from 1.0 to 10.0 centistokes and a boiling point range of from 150° C. to 270° C.

8. A recording material as in claim 1, wherein said paraffin oil is-used in admixture with at least one selected from the group consisting of aromatic hydrocarbons, chlorinated paraffins, aromatic esters and aromatic diethers.

9. A recording material as in claim 1, wherein the proportion of the color former in the total content of substances contained in said microcapsules is from 4 to 25% by weight and the proportion of the paraffin oil in the core substance is from 20 to 96% by weight.

10. A recording material as in claim 1, wherein the proportion of the color former in the total content of substances contained in said microcapsules is from 6 to 20% by weight and the proportion of the paraffin oil in the core substance is from 30 to 84% by 5 weight.

11. A recording material as in claim 1, wherein when $R_2$ is an alkyl group, the total number of carbon atoms of R, R', Y, $R_1$ and $R_2$ is 13 or more, and when $R_2$ is an aryl group, the total number of carbon atoms of R, R', Y, $R_1$ and $R_2$ is 18 or more.

12. A recording material as in claim 1, wherein at least one of R, R', Y' and $R_1$ has 4 or more carbon atoms.

13. A recording material as in claim 1, wherein the concentration of the color former in the microcapsule is at least 60%.

* * * * *